US008107856B2

(12) United States Patent
Gotoh et al.

(10) Patent No.: US 8,107,856 B2
(45) Date of Patent: Jan. 31, 2012

(54) FIXING DEVICE AND IMAGE FORMING APPARATUS INCLUDING THE SAME

(75) Inventors: Yasutaka Gotoh, Saitama (JP); Kiichirou Arikawa, Saitama (JP); Shigeru Watanabe, Saitama (JP); Hiroko Furukata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 788 days.

(21) Appl. No.: 12/243,282

(22) Filed: Oct. 1, 2008

(65) Prior Publication Data

US 2009/0226211 A1 Sep. 10, 2009

(30) Foreign Application Priority Data

Mar. 10, 2008 (JP) ..... P2008-059729

(51) Int. Cl.
*G03G 15/16* (2006.01)
*G03G 21/00* (2006.01)

(52) U.S. Cl. ..... 399/122; 399/124

(58) Field of Classification Search ..... 399/122, 399/124, 125, 328
See application file for complete search history.

(56) References Cited

U.S. PATENT DOCUMENTS

| | | | | |
|---|---|---|---|---|
| 6,904,257 | B2 * | 6/2005 | Tomatsu | 399/328 |
| 7,003,246 | B2 * | 2/2006 | Gogate et al. | 399/122 |
| 7,263,311 | B2 * | 8/2007 | Ikeda | 399/122 |
| 7,330,682 | B2 | 2/2008 | Shinshi | |
| 7,505,713 | B2 * | 3/2009 | Lee et al. | 399/122 |

FOREIGN PATENT DOCUMENTS

| | | |
|---|---|---|
| JP | 2000-214718 | 8/2000 |
| JP | 2006-048005 | 2/2006 |

* cited by examiner

*Primary Examiner* — Sandra Brase
(74) *Attorney, Agent, or Firm* — Morgan, Lewis & Bockius LLP

(57) ABSTRACT

A fixing device including a heating member, a pressing member that presses the heating member, a switching unit that switches a press contact force of the pressing member and a container body that accommodates the heating member, the pressing member, and the switching unit, wherein the switching unit, includes a drive member that moves the pressing member in a predetermined direction and an auxiliary drive member that is connected to the drive member and relatively moves with the drive member, and the auxiliary drive member, in a case where the container body is placed in an image forming apparatus including a lid, switches between a operative association state and a nonoperative association state, and the auxiliary drive member including a returning section that returns a tip of the auxiliary drive member to a position crossing a movement trajectory of the lid in the nonoperative association state.

7 Claims, 7 Drawing Sheets

FIXING DEVICE AND IMAGE FORMING APPARATUS INCLUDING THE SAME

This application is based on and claims priority under 35 U.S.C. 119 from Japanese Patent Application No. 2008-059729 filed Mar. 10, 2008.

BACKGROUND

1. Technical Field

This invention relates to an improvement in a fixing device for fixing an unfixed toner image onto a recording medium by heating and pressurizing, and an image forming apparatus including the fixing device.

2. Related Art

Hitherto, in an image forming apparatus of a copier, a printer, etc., using electrophotography, etc., a fixing device has been widely used wherein a recording medium is inserted between a pair of fixing members made up of a heating member and a pressing member, and an unfixed toner image transferred onto the recording medium is heated and pressurized to form a permanent image.

In the fixing device, a fixing device that switches a press contact force of a pressing member that presses into a heating member for setting an appropriate press contact force (nip load) corresponding to a recording medium, jam handling, etc., is known.

SUMMARY

According to an aspect of the present invention, there is provided a fixing device including a heating member that includes an internal heating source and is rotatable; a pressing member that presses the heating member into contact therewith; a switching unit that switches a press contact force of the pressing member, which is applied to the heating member; and a container body that accommodates the heating member, the pressing member and the switching unit, wherein the switching unit includes: a drive member that is rotatable and moves the pressing member in a predetermined direction; and an auxiliary drive member that is connected to the drive member and relatively moves with the drive member in a predetermined range, and the auxiliary drive member, in a case where the container body is placed in an image forming apparatus including a lid that is openable and closable, switches between an operative association state where the auxiliary drive member is driven in a predetermined direction in association with opening/closing operation of the lid of the image forming apparatus and a nonoperative association state where the auxiliary driving member is dissociated from opening/closing operation of the lid, the auxiliary drive member including a returning section that returns a tip of the auxiliary drive member to a position crossing a movement trajectory of the lid in the nonoperative association state.

BRIEF DESCRIPTION OF THE DRAWINGS

Exemplary embodiment of the present invention will be described in detail based on the following figures, wherein.

DETAILED DESCRIPTION

Referring now to the accompanying drawings, there are shown an exemplary embodiment of the invention.

Figure 1:
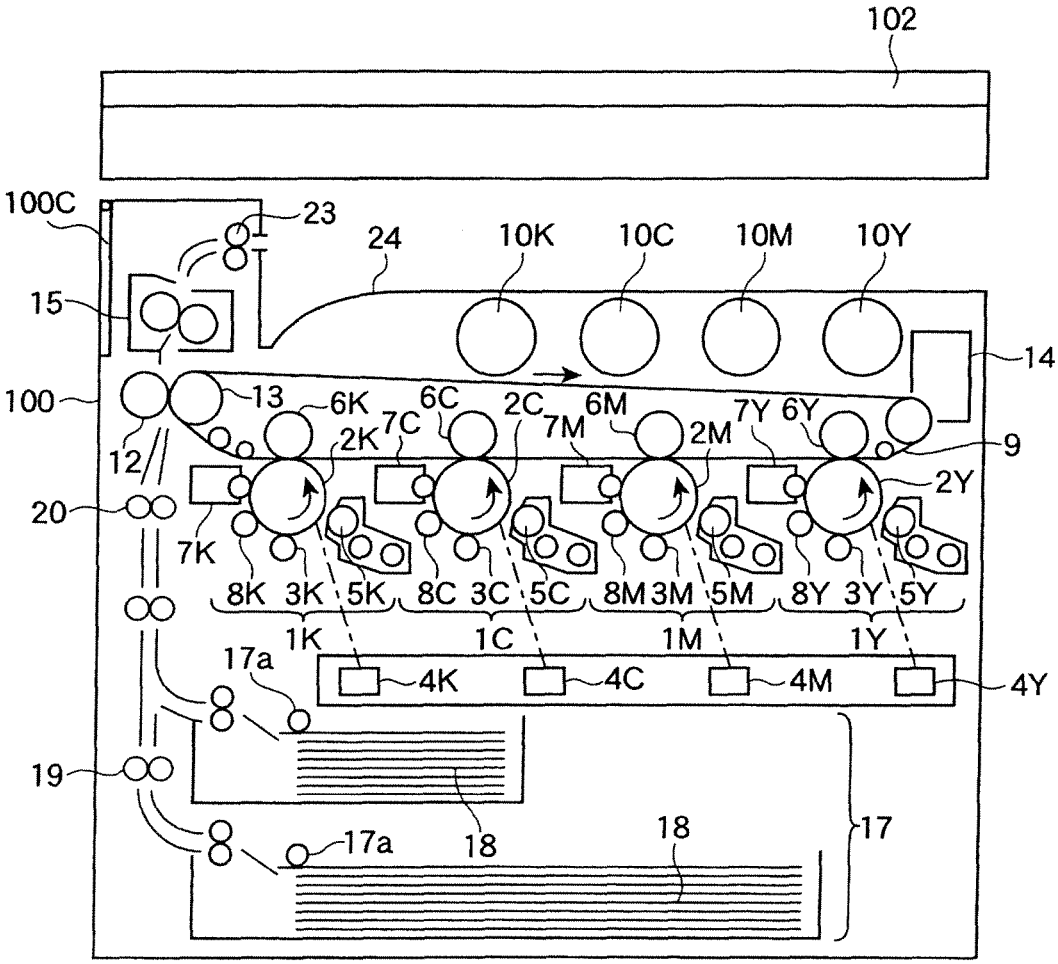
FIG. 1 is a schematic configuration drawing to show an exemplary embodiment of an image forming apparatus according to the invention.

FIG. 1 shows the schematic configuration of an exemplary embodiment of an image forming apparatus that may incorporate the present invention. FIG. 1 is a schematic configuration drawing of a tandem color image forming apparatus that may incorporate the present invention.

In an image forming apparatus 100 according to the exemplary embodiment, color image information of a color document read through an image reader 102 and color image information, etc., sent from a personal computer, an image data input unit (not shown), etc., is input. Then image processing is performed for the input image information.

In FIGS. 1, 1Y, 1M, 1C, and 1K denote image forming units that forms color toner images of yellow (Y), magenta (M), cyan (C), and black (K) respectively and the image forming units are disposed in series in the order of 1Y, 1M, 1C, and 1K along the traveling direction of an endless intermediate transfer belt 9 stretched by the plural stretch roll. The intermediate transfer belt 9 is an intermediate transfer body to which the color toner images formed in order by the image forming units 1Y, 1M, 1C, and 1K are transferred in a superposition state. The intermediate transfer belt 9 is inserted between photoconductive drums 2Y, 2M, 2C, and 2K that are electrostatic latent image supporters corresponding to the image forming units 1Y, 1M, 1C, and 1K, and primary transfer rolls 6Y, 6M, 6C, and 6K disposed facing the photoconductive drums 2Y, 2M, 2C, and 2K and is formed so as to circulate in the arrow direction. The multiple color toner images transferred onto the intermediate transfer belt 9 are collectively transferred onto a record sheet 18 that is a recording medium fed from a sheet feed cassette 17, etc., and then fixed on the record sheet 18 by a fixing device 15 and the record sheet 18 with a color image formed thereon is ejected to the outside.

The image reader 102 illuminates a document placed on platen glass from a light source (not shown) and reads a reflected light image from the document at a predetermined resolution by an image read element made of a CCD sensor, etc., through a scanning optical system.

Each of the image forming units 1Y, 1M, 1C, and 1K has a similar configuration and is roughly made up of the photoconductive drum 2Y, 2M, 2C, 2K rotating at predetermined rotation speed in a direction of arrow, a charging roll 3Y, 3M, 3C, 3K that uniformly charges the surface of the photoconductive drum 2Y, 2M, 2C, 2K, an exposure device 4Y, 4M, 4C, 4K that exposes an image corresponding to each color to form an electrostatic latent image on the surface of the photoconductive drum 2Y, 2M, 2C, 2K, a developing device 5Y, 5M, 5C, 5K that develops the electrostatic latent image formed on the photoconductive drum 2Y, 2M, 2C, 2K, a detachable toner cartridge 10Y, 10M, 10C, 10K that supplies toner of a predetermined color to the developing device 5Y, 5M, 5C, 5K, and a drum cleaning device 7Y, 7M, 7C, 7K.

Further, in the exemplary embodiment, the photoconductive drum 2Y, 2M, 2C, 2K includes a photosensitive layer made up of an organic photosensitive material, an amorphous selenium based photosensitive material, an amorphous silicon based photosensitive material, etc., on the surface of a metal drum rotating in the arrow direction, and the charging roll 3Y, 3M, 3C, 3K comes in contact with the surface of the photoconductive drum 2Y, 2M, 2C, 2K that charges the photosensitive layer at a predetermined potential.

An image forming process in the described image forming apparatus will be discussed by taking the image forming unit 1Y that forms a yellow toner image as a representative example.

The surface of the photoconductive drum 2Y is uniformly charged by the charging roll 3Y. Next, scan exposure corresponding to a yellow image is executed by a laser beam output from the exposure device 4Y, for example, based on image information read through the image reader 102, and an electrostatic latent image corresponding to the yellow image is formed on the surface of the photoconductive drum 2Y.

The electrostatic latent image corresponding to the yellow image is made a yellow toner image by the developing device 5Y and the yellow toner image is primarily transferred onto the intermediate transfer belt 9 by the press contact force and the electrostatic attraction force of the primary transfer roll 6Y forming a part of primary transfer section. The yellow toner remaining on the photoconductive drum 2Y after the primary transfer is scraped off by the drum cleaning device 7Y. Then, the surface of the photoconductive drum 2Y is neutralized by a neutralization device 8Y and then is again charged by the charging roll 3Y for the next image forming cycle.

In the image forming apparatus 100 that forms a multicolor image, an image forming process similar to that described above is also executed in the image forming units 1M, 1C, and 1K at the timings considering the relative position differences among the image forming units 1Y, 1M, 1C, and 1K, and full color toner images are formed on the intermediate transfer belt 9 in a superposition state. As the intermediate transfer belt 9, a belt formed like an endless belt by forming a belt of a synthetic resin film of polyimide, etc. that has flexibility and connecting both ends of the synthetic resin film formed like a belt by welding, etc., may be used.

The full color toner images primarily transferred onto the intermediate transfer belt 9 are secondarily transferred onto the record sheet 18 that is transported to a secondary transfer position at a predetermined timing by the press contact force and the electrostatic attraction force produced between a backup roll 13 that supports the intermediate transfer belt 9 and a secondary transfer roll 12 that presses into contact with the backup roll 13 at a predetermined timing. The remaining toner on the intermediate transfer belt 9 that cannot be secondarily transferred onto the record sheet 18 is transported to a belt cleaning device 14 in a state in which the toner remains deposited on the intermediate transfer belt 9, and is removed from the top of the intermediate transfer belt 9 by the belt cleaning device 14 for the next image forming.

On the other hand, the record sheet 18 of a predetermined size as an example of a recording medium is fed by a sheet feed roll 17*a* from the sheet feed cassette 17 placed at the bottom of the image forming apparatus 100. The fed record sheet 18 is transported to the secondary transfer position of the intermediate transfer belt 9 at a predetermined timing by the plural transport roll 19 and the plural registration roll 20. The full color toner images are collectively transferred to the record sheet 18 from the intermediate transfer belt 9 by the backup roll 13 and the secondary transfer roll 12 as secondary transfer section, as described above.

The record sheet 18 to which the full color toner images are secondarily transferred from the intermediate transfer belt 9 is separated from the intermediate transfer belt 9 and then is transported to the fixing device 15 disposed downstream from the secondary transfer section and the fixing device 15 fixes the toner images onto the record sheet 18 by heat and pressure. The record sheet 18 after the toner images are fixed is ejected through a eject roll 23 to a eject tray 24. In the exemplary embodiment, the fixing device 15 is of a unit structure and a cover 100C serving as a lid that opens and closes is provided in the chassis of the image forming apparatus 100. The cover 100C is opened and is closed, whereby the fixing device may be replaced and paper jam handling at the sheet jam time, etc., may be performed. The image forming apparatus that may incorporate the invention is not limited to the configuration described above and may also be applied to a printer, etc., for example, having an opening and closing cover for housing a fixing device of a unit structure, of course.

Figure 2:
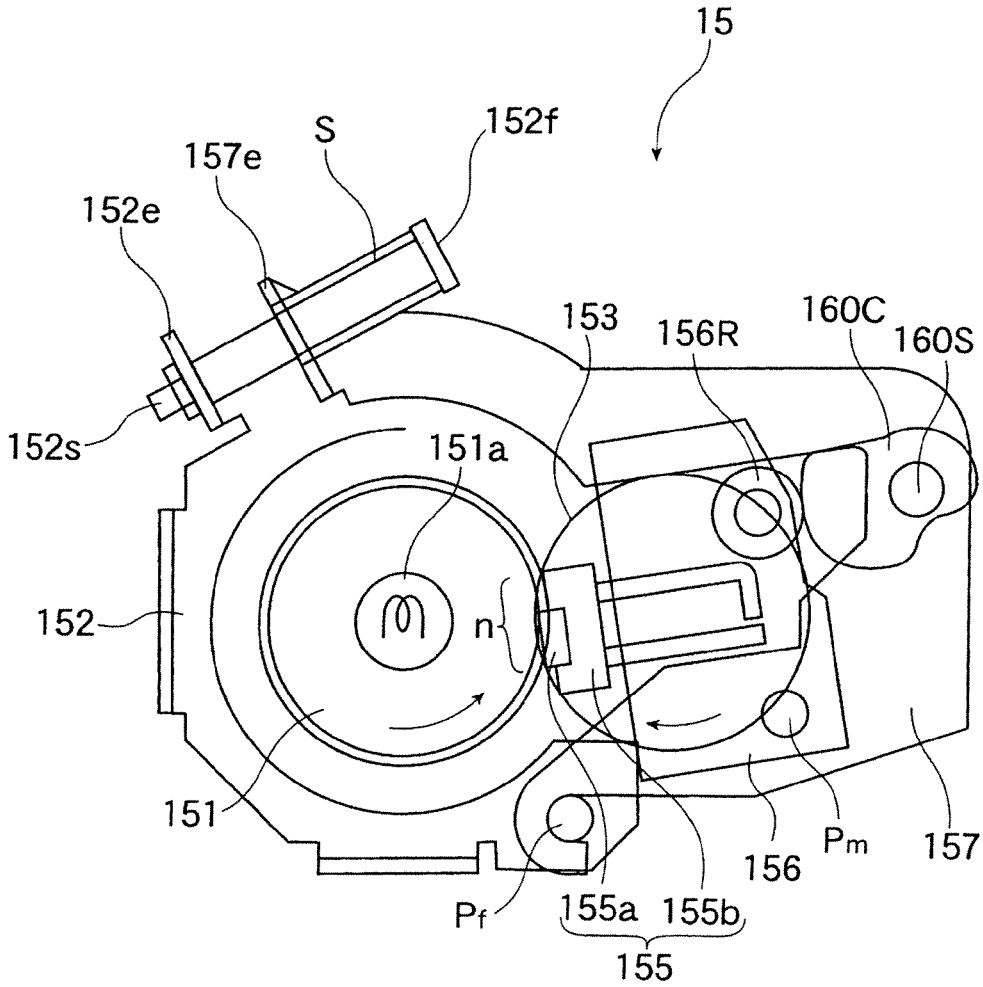
FIG. 2 is a schematic drawing to describe the configuration of a fixing device according to the invention.
Figure 3:
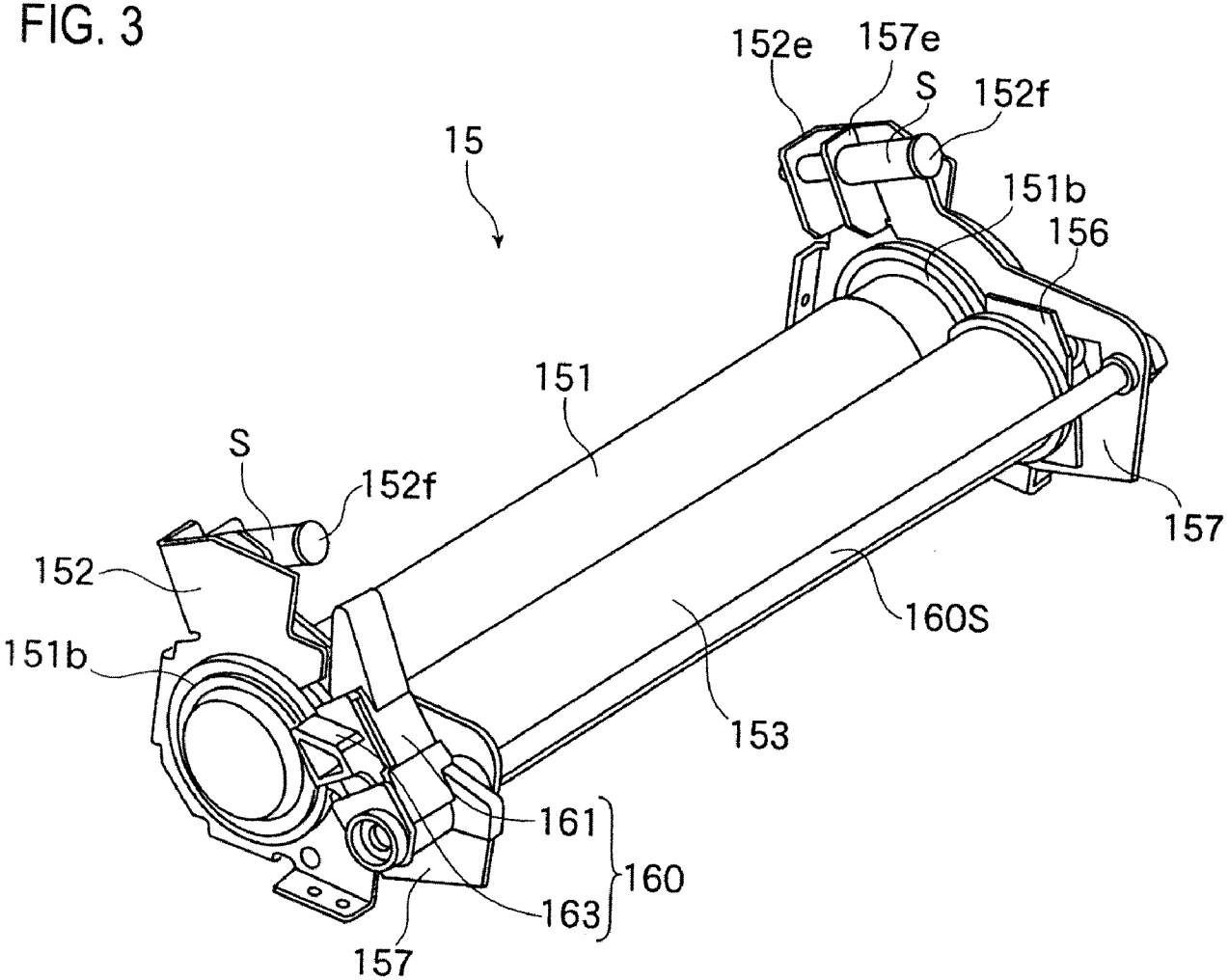
FIG. 3 is a perspective view to describe the configuration of the fixing device according to the invention.

Next, the configuration of the fixing device according to the exemplary embodiment will be discussed with reference to FIGS. 2 and 3. FIG. 2 is a schematic sectional view to show the schematic configuration of the fixing device according to the exemplary embodiment of the invention, and FIG. 3 is a perspective view to show the schematic configuration of the fixing device. For clarification, switching unit is not shown in FIG. 2.

As shown in FIGS. 2 and 3, the fixing device 15 according to the exemplary embodiment includes a heating roll 151 that is cylindrical and is containing an internal heating source 151*a* of a halogen lamp, etc., a fixing belt 153 shaped like an endless belt that rotates with the heating roll 151 and transports a sheet sandwiched between the fixing belt 153 and the heating roll 151, a sub pressing member 155 that placed in contact with the inside of the fixing belt 153 and forms a predetermined fixing nip area n between the heating roll 151 and the fixing belt 153, switching unit 160 disposed at the rear of the fixing belt 153 and switches the press contact force of the fixing belt 153 into the heating roll 151 (described later in detail), and the like.

The heating roll 151 as a heating member is rotated in a predetermined direction (in the exemplary embodiment, counterclockwise) by a motor (not shown) and is supported by plate-like fixed support members 152 provided in both end parts in an axial direction for rotation (length direction) through a bearing 151*b*. The heating roll 151 according to the exemplary embodiment has an elastic layer of silicone rubber, etc., formed on the surface of a cylindrical core made of metal of aluminum, etc., having an excellent mechanical strength and good heat conductivity. Further, a release layer is provided on a surface of the elastic layer to prevent offset of an unfixed toner image on the record sheet 18. A temperature sensor (not shown) that measures the surface temperature of the heating roll 151 is disposed in the surrounding of the heating roll 151 in the exemplary embodiment. Temperature control of the heating source 151*a* is performed so that the surface temperature of the heating roll 151 becomes a predetermined temperature based on the temperature sensor.

In the exemplary embodiment, provided in the upper part of the fixed support member 152 that supports the heating roll 151 for rotation are a plate-like fixed end part 152*e* that a moving end part 157*e* (described later) abuts, provided so as to project in the axial direction of the heating roll 151 and a disk-like attachment end part 152*f* fastened to the fixed end part 152*e* through a bolt axis 152*s* so as to face the fixed end part 152*e* with a predetermined spacing (in the example, face the fixed end part 152*e* in a slanting up direction of the fixed end part 152*e*), wherein the attachment end part 152*f* attaches a compression spring S.

On the other hand, the fixing belt 153 may be of a single-layer structure; in the exemplary embodiment, however, a belt of a layered structure having a demold layer formed on the surface of the base material is used as the fixing belt 153. As the base material of the fixing belt 153, for example, a resin base material of thermosetting polyimide, thermoplastic polyimide, polyamide, polyamide-imide, etc., or a metal base material of stainless steel, nickel, copper alloy, etc., is used if it has heat resistance property. As the demold layer, a layer with good releasability of toner deposited on the surface is preferred and as a material of the layer, for example, fluorine resin of PTFE (polytetrafluoroethylene), PFA (tetrafluoroethylene-perfluoroalkoxy ethylene copolymer), FEP (tetrafluoroethylene-hexafluoropropylene copolymer), etc., is used.

As shown best in FIG. 2, in the exemplary embodiment, in the fixing belt 153, the sub pressing member 155 roughly shaped like a rectangular parallelepiped that presses the fixing belt 153 on the opposed face to the heating roll 151 and forming the predetermined fixing nip area n is disposed so as to extend in the axial direction, and a belt traveling guide (not shown) roughly circular in cross section made of a resin having low heat conductivity and high rigidity, for example, is disposed in the axial direction. Both axial end parts of the sub pressing member 155 are attached to a first moving support member 156 shaped like a roughly square plate, and a guide roll 156R formed for rotation is projected in the axial direction in the upper right end part of the first moving support member 156. Further, the first moving support member 156 is attached to a second moving support member 157 roughly shaped like an inverse dogleg. More specifically, the first moving support member 156 is rotatably attached to the second moving support member 157 at a movable supporting point Pm positioned at the end roughly below the guide roll 156R provided in the upper right end part of the first moving support member 156, and the second moving support member 157 is attached to the fixed support member 152 for rotation at a fixed supporting point Pf positioned at the lower end part of the second moving support member 157. A plate-like moving end part 157*e* projected in the axial direction so as to face the fixed end part 152*e* of the fixed support member 152 described above is formed in the upper end part of the second moving support member 157, and the compression spring S is placed through the bolt axis 152*s* between the moving end part 157*e* of the second moving support member 157 and the attachment end part 152*f* of the fixed support member 152. Further, at a position opposed to the guide roll 156R of the first moving support member 156, a drive cam 160C as an eccentric rotation member is disposed so as to be in contact with (abut) the guide roll 156R, and is swingably supported by a rotation shaft 160S extending in the axial direction at the rear of the fixing belt 153. The fixed support members 152, the first moving support members 156, the second moving support members 157, and the like are provided so as to face each other in both axial end parts of the heating roll 151 and the fixing belt 153 and the rotation shaft 160S is connected to the second moving support members 157 at both the ends, as best shown in FIG. 3. The switching unit 160 according to the exemplary embodiment is provided in one end part of the rotation shaft 160S (in the example, the front side in FIG. 3) that drives the drive cam 160C to switch the press contact force of the fixing belt 153 into the heating roll 151 (nip load) through the sub pressing member 155 attached to the first moving support member 156.

The sub pressing member 155 in the exemplary embodiment is made up of an elastically deformable pad part 155*a* disposed upstream in the rotation direction of the fixing belt 153 in the fixing nip area n and a head part 155*b* adjacent to the pad part 155*a*, disposed downstream in the rotation direction of the fixing belt 153 in the fixing nip area n, and having higher rigidity than that of the pad part 155*a*, as shown in FIG. 2. The pad part 155*a* is formed of an elastic material of silicone rubber, etc., and forms a pre-nip area of the fixing nip area n between the heating roll 151 and the fixing belt 153 so as to stably fix an unfixed toner image on a record sheet 18. To maintain small frictional resistance with the fixing belt 153 and more smooth rotation of the fixing belt 153, for example, a low friction sheet made of a fluorine resin sheet of PTFE, PFA, etc., may be provided on the surface of the pad part 155*a* by bonding, etc.

The head part 155*b* forms a post-nip area (release nip area) in the fixing nip area n and provides a higher pressure distribution than the pre-nip area. As the head part 155*b*, for example, a high-rigidity material (inelastic material) made up of metal of aluminum, stainless steel, steel, copper, brass, etc., an alloy, and resin material is mainly used. In the exemplary embodiment, the high-rigidity head part 155*b* is formed like a recess and the pad part 155*a* is held in the recess of the head part 155*b* so that both the parts are formed in one piece. Thus, the pad part 155*a* of an elastic member is provided at the entrance and the head part 155*b* of an inelastic member is provided at the exit to form the fixing nip area n, whereby when an image on a record sheet 18 of a usual thickness is fixed, good fixing performance and good release performance are provided at the same time.

First Exemplary Embodiment

Figure 4:
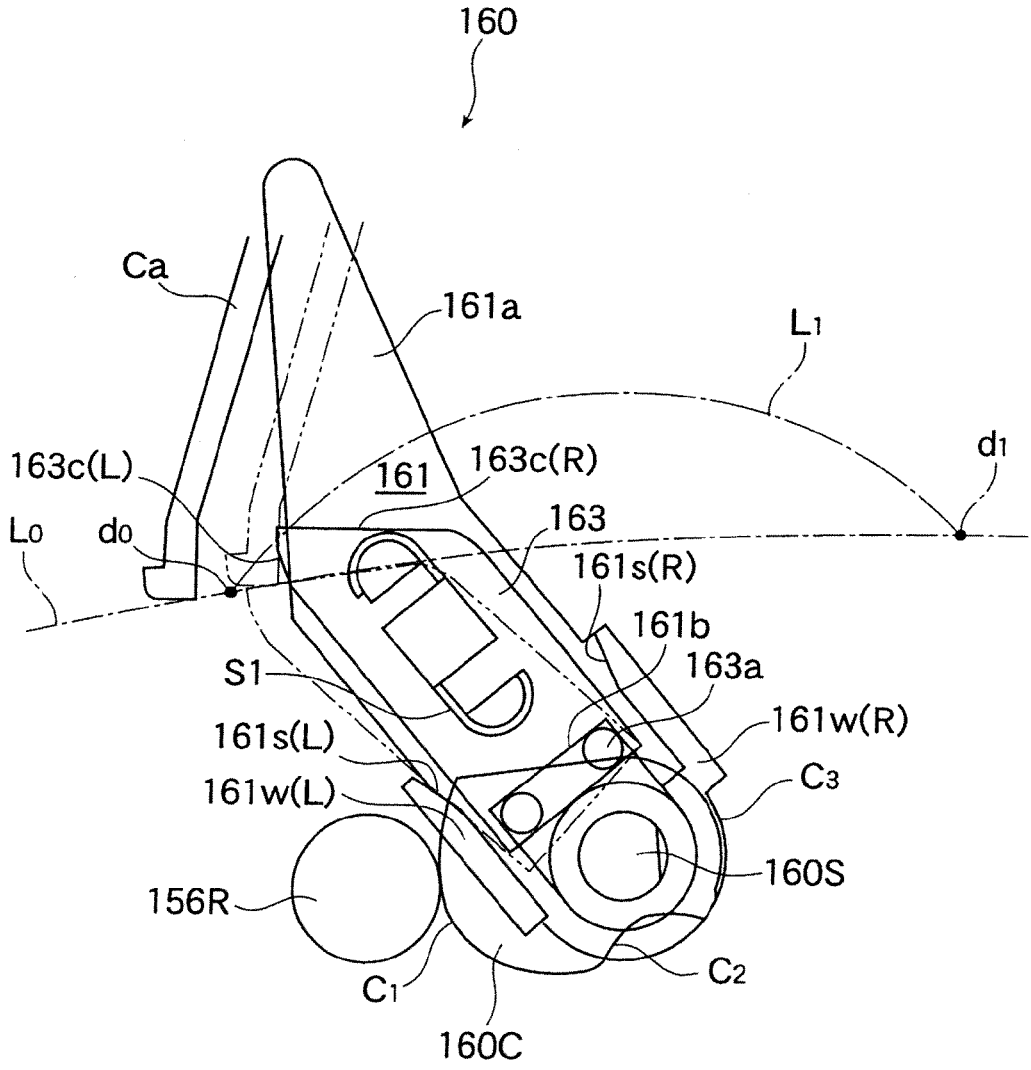
FIG. 4 is a schematic drawing to describe the configuration of switching unit according to the invention.
Figure 5:
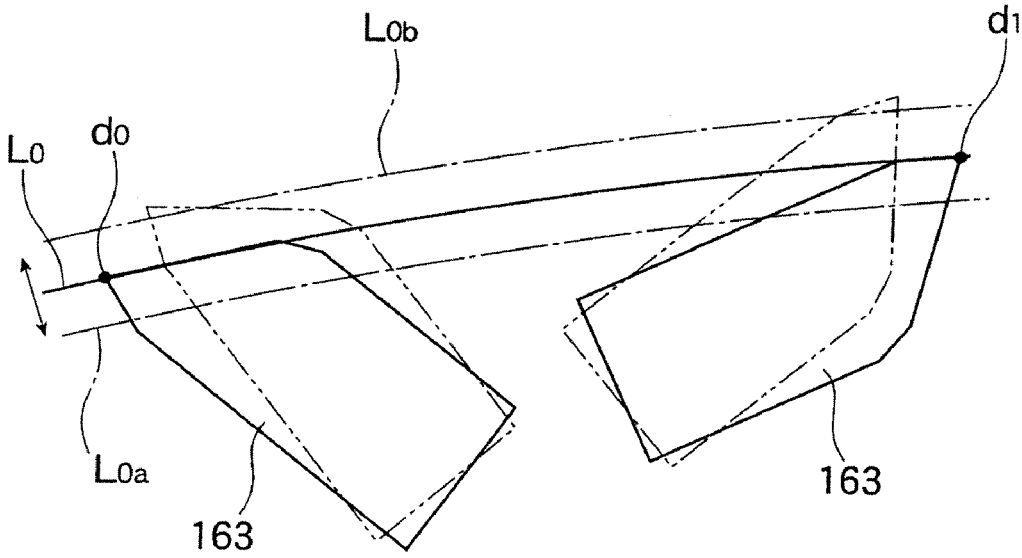
FIG. 5 is a schematic drawing to describe cancel of parts tolerance by the switching unit according to the invention.

Next, a first exemplary embodiment of the switching unit according to the invention will be further discussed with reference to FIGS. 4 and 5. FIG. 4 is a schematic drawing to describe the configuration of the switching unit according to the exemplary embodiment, and FIG. 5 is a schematic drawing to describe cancel of parts tolerance by the switching unit.

As shown in FIG. 4, the switching unit 160 according to the exemplary embodiment includes the above-mentioned drive cam 160C, a drive lever 161 serving as a drive member placed on the axial outside of the drive cam 160C (in the figure, the front side) and placed on the same axle as the drive cam 160C and an auxiliary drive lever 163 serving as a auxiliary drive member placed on the axial outside of the drive lever 161 and connected to the drive lever 161 so as to relatively move with the drive lever 161 in a predetermined range.

In the exemplary embodiment, the drive cam 160C is joined to the drive lever 161 and rotates with the drive lever 161 in one and has a predetermined curved surface shape formed on the periphery with a high load surface $C_1$, a release surface $C_2$, and a low load surface $C_3$ as contact surfaces with the guide roll 156R. More specifically, the high load surface $C_1$ and the low load surface $C_3$ are formed on the periphery of the drive cam 160C corresponding to the movable range of the drive lever 161, and the recess-shaped release surface $C_2$ for retaining the guide roll 156R is formed in an intermediate part. The distance between each of the contact surfaces $C_1$ to $C_3$ and the rotation shaft (rotation center) 160S is set so that high load surface $C_1$>low load surface $C_3$>release surface $C_2$. Accordingly, when the high load surface $C_1$ of the drive cam 160C is in contact with the guide roll 156R of the first moving support member 156, a high nip load (in the example, about 250 N) to fix an unfixed toner image on a record sheet 18 of a usual thickness (for example, 0.05 to 0.15 mm) is given to the fixing nip area n; when the release surface $C_2$ is in contact with the guide roll 156R, the nip load is released; and when the low load surface $C_3$ is in contact with the guide roll 156R, a low nip load (in the example, about 30 to 40 N) to fix an image on a cardboard of an envelope, etc., (for example, 0.1 to 0.8 mm) is given to the fixing nip area n. That is, in the fixing device 15 in the exemplary embodiment, any of the three modes of high press contact force (high nip load) mode to fix an image on a record sheet of a usual thickness (which will be hereinafter also referred to as usual mode), low press contact force (low nip load) mode to fix an image on a cardboard of an envelope, etc., (which will be hereinafter also referred to as envelope mode), and release mode to release the nip load for jam handling, etc., may be set in response to the rotation position of the drive lever 161.

The drive lever 161, which is a member roughly shaped like a dogleg in cross section having a handle part 161*a*, is connected in a lower end part to the rotation shaft 160S and is formed for rotation in a predetermined range on the same axle as the drive cam 160C. A rectangular hollow part 161*b* is formed above the rotation shaft 160S of the drive lever 161 and a right wall part 161*w* (R) and a left wall part 161*w* (L) axially projecting are formed on both left and right sides of the hollow part 161*b*. Further, inclined wall parts 161*s* (R) and 161*s* (L) open to the outside are formed on the right and left wall parts 161*w* (R) and 161*w* (L).

The auxiliary drive lever 163 is elastically connected to the drive lever 161 so as to be retained thereon at a predetermined relative position to the drive lever 161 (in the example, a position at which the auxiliary drive lever 163 becomes roughly parallel along the drive lever 161) through a connection spring S1 shaped like a letter S. The auxiliary drive lever 163 has a tip part formed like a triangle and a lower end part formed with two projection parts 163*a* shaped like a pin axially projecting toward the drive lever 161. The projection parts 163*a* of the auxiliary drive lever 163 are inserted into the hollow part 161*b* of the drive lever 161, whereby the auxiliary drive lever 163 may make a move relative to the drive lever 161 in a predetermined range between the side wall parts 161*w* (R) and 161*w* (L) of the drive lever 161 by the connection spring S1 as return means.

In the exemplary embodiment, the auxiliary drive lever 163 is driven in operative association with the opening/closing operation of the cover 100C. Specifically, a cover claw part Ca shaped like a projection is formed in the axial end part of the cover 100C corresponding to the auxiliary drive lever 163 so as to drive the auxiliary drive lever 163. The tip part of the auxiliary drive lever 163 is placed at a position crossing a movement trajectory $L_0$ drawn by the tip of the cover 100C (cover claw part Ca) when viewed from the rotation shaft 160S in a state in which no drive torque is given (nonoperative association state out of contact with the cover claw part Ca). Specifically, the auxiliary drive lever 163 is placed so that both end parts $d_0$ and $d_1$ of a movement trajectory $L_1$ drawn by the tip of the auxiliary drive lever 163 cross on the movement trajectory $L_0$ drawn by the tip of the cover 100C (cover claw part Ca). The movement trajectory $L_1$ of the auxiliary drive lever 163 is thus set with respect to the movement trajectory $L_0$ of the cover 100C, whereby the auxiliary drive lever 163 that returns to the predetermined relative position in the nonoperative association state may be realized easily.

The nonoperative association state refers to a state in which the auxiliary drive member does not receive the drive force of the lid, namely, a state in which the lid and the auxiliary drive member are not in contact with each other. In other words, the nonoperative association state refers to a state in which the auxiliary drive member waits for being driven by the lid.

The drive section of the switching unit 160 is divided into the drive lever 161 and the auxiliary drive lever 163 and one drive member (in the example, the auxiliary drive lever 163) is returned beyond the movement trajectory L of the cover 100C (cover claw part Ca) in the nonoperative association state. Thus, steadily operative association with the cover 100C may be realized by simple design without considering the dimension tolerance based on the parts shapes of the cover claw part Ca, the auxiliary drive lever 163, etc., that are the members operatively associated with the opening/closing operation of the cover 100C, as described below:

Generally, in the configuration wherein the drive member (in the example, the drive lever 161) operatively associated with the switching position of the pressing member (in the example, the fixing belt 153) is directly driven with the cover 100C, it becomes necessary to retain and stop the drive member at a predetermined position corresponding to the switching position of the pressing member and it becomes necessary to drive the drive member with different members in the opening operation and the closing operation of the cover 100C. To reliably drive the drive member in a contact manner using different members, it is necessary to sufficiently consider steadily position tolerance accompanying the parts tolerance of the members (particularly, since the cover 100C has low rigidity, position variation caused by the parts tolerance of the cover claw part Ca becomes large) and a problem of complicated design occurs. Further, to drive the drive cam 160C by separate drive members in operating and closing the cover 100C, if the cover 100C and the drive member strike at the air, a problem of engagement with the drive member or damage caused by so-called pinioning occurs in operation in an opposite direction.

In contrast, according to the switching unit 160 according to the exemplary embodiment with the drive member divided into the drive lever 161 and the auxiliary drive lever 163 as described above, the auxiliary drive lever 163 rotates to $d_0$ or $d_1$ on the movement trajectory $L_0$ of the cover claw part Ca and the auxiliary drive lever 163 rotates relatively to the drive lever 161 to a position not crossing the movement trajectory $L_0$ of the cover claw part Ca and is brought away so that the cover claw part Ca climbs over the auxiliary drive lever 163 and the auxiliary drive lever 163 rotates in the opposite direction by the elastic force of the connection spring S1 and returns, and thus the tip of the auxiliary drive lever 163 always crosses the movement trajectory $L_0$. That is, as shown schematically in FIG. 5, if the movement trajectory $L_0$ of the cover claw part Ca varies in an up and down direction $L_0a$, $L_0b$, for example, because of the parts tolerance, the auxiliary drive lever 163 is disassociated from the cover claw part Ca on the varied movement trajectory $L_0a$, $L_0b$ and returns to a predetermined relative position with respect to the varied movement trajectory $L_0a$, $L_0b$. Thus, the dimension tolerance based on the parts shapes of the cover member 100C (cover claw part Ca), the auxiliary drive lever 163, etc., is canceled, the allowable range of the relative position tolerance of each part is enlarged, and improvement of the operation reliability because of simple design is realized and more steadily contact drive is also performed by the cover claw part Ca and the auxiliary drive lever 163.

In the exemplary embodiment, the width of the auxiliary drive lever 163 is formed narrower than the width of the drive lever 161 and the lower end part of the auxiliary drive lever 163 is housed between the side wall parts 161*w* (R) and 161*w* (L) of the drive lever 161. That is, in the nonoperative association state, the auxiliary drive lever 163 is housed and placed in the axial projection area of the drive lever 161. The drive member of one division part (in the example, the auxiliary drive lever 163) is thus housed and placed in the projection area of the other drive member (in the example, the drive lever 161), thereby contributing to more miniaturization of the apparatus.

Further, in the exemplary embodiment, the shape of each triangular contact surface 163*c* of the tip of the auxiliary drive lever 163 is formed so that either of the left and right contact surfaces 163*c* is roughly orthogonal to the movement trajectory $L_0$ in a state in which the auxiliary drive lever 163 returns (wait state for the cover claw part Ca to come in contact with) and that the contact surface 163*c* follows the movement trajectory $L_0$ when the auxiliary drive lever 163 is disassociated from the cover claw part Ca. Specifically, for example, to open the cover 100C, the auxiliary drive lever 163 returns so that the left contact surface 163*c* (L) of the auxiliary drive lever 163 with which the cover claw part Ca comes in contact is roughly orthogonal to the movement trajectory $L_0$ and the left contact surface 163*c* (L) is formed as a shape to follow the movement trajectory $L_0$ of the cover claw part Ca when the cover claw part Ca is disassociated from the auxiliary drive lever 163 (similar shape to the movement trajectory $L_0$). Likewise, to close the cover 100C, the auxiliary drive lever 163 returns so that the right contact surface 163*c* (R) with which the cover claw part Ca comes in contact is roughly orthogonal to the movement trajectory $L_0$ and the right contact surface 163*c* (R) is formed as a shape to follow the movement trajectory $L_0$ of the cover claw part Ca when the cover claw part Ca is disassociated from the auxiliary drive lever 163 (similar shape to the movement trajectory $L_0$). The contact surfaces 163*c* (R) and 163*c* (L) of the auxiliary drive lever 163 are thus formed, whereby when the cover 100C is opened or closed, drive with steadily engagement with the cover claw part Ca is made possible and smooth disassociating from the cover claw part Ca is promoted.

Figure 6A:
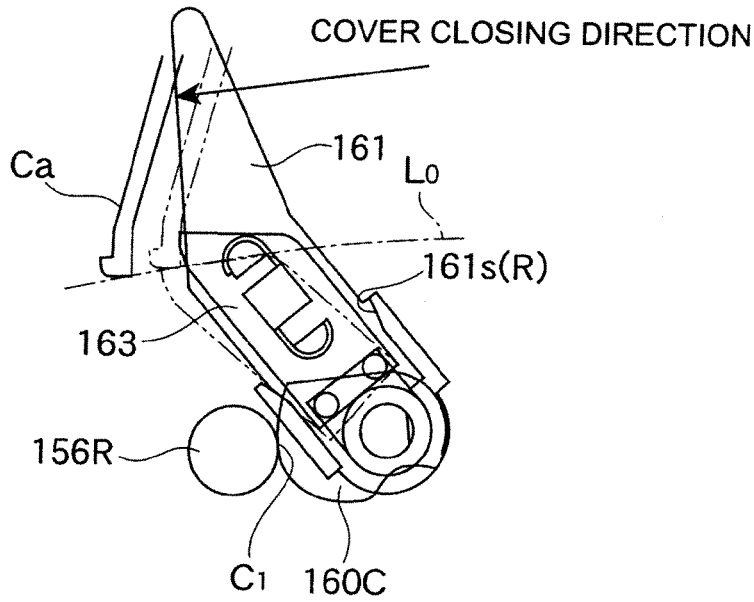
FIG. 6 is a schematic drawing to describe the operation of the switching unit according to the invention.
Figure 6B:
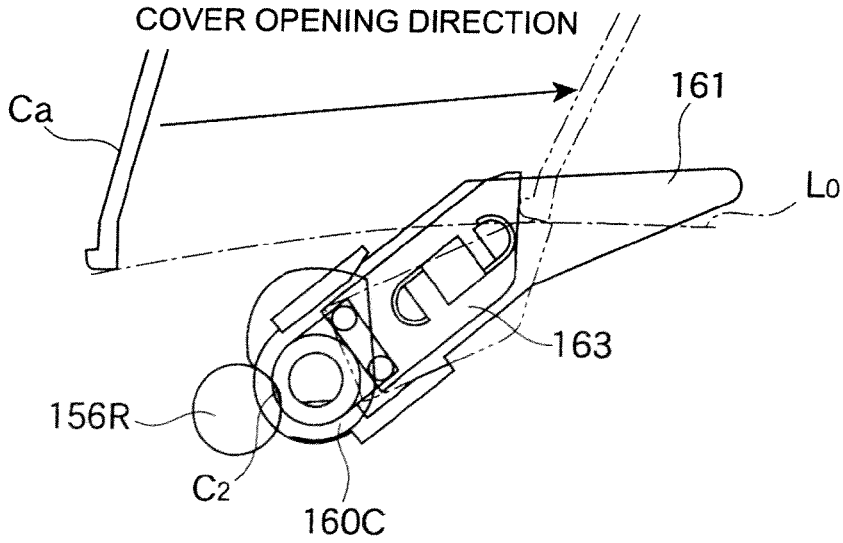

The operation of the fixing device 15 according to the exemplary embodiment described above will be discussed below with reference to FIGS. 2 and 6: FIG. 6(*a*) is a schematic drawing to show a state in which the cover 100C is closed, and FIG. 6(*b*) is a schematic drawing to show a state in which the cover 100C is opened.

As shown in FIG. 6(*a*), in a state in which the cover 100C of the fixing device 15 is closed, the high load surface $C_1$ of the drive cam 160C is in contact with the guide roll 156R and a high nip load is given to the predetermined fixing nip area n between the heating roll 151 and the fixing belt 153 by the urging force of the compression spring S. At this time, the pad part 155*a* and the head part 155*b* of the sub pressing member 155 placed at the rear of the fixing belt 153 press the fixing belt 153 to form the fixing nip area n and the fixing performance and the release performance in the usual mode are provided at the same time as previously described with reference to FIG. 2.

If the cover 100C is opened (the cover claw part Ca is moved in the opening direction) from the state, the cover claw part Ca and the auxiliary drive lever 163 retained at the position crossing the movement trajectory $L_0$ come in contact with each other and the auxiliary drive lever 163 is rotated in a predetermined direction (in the example, clockwise). The auxiliary drive lever 163 makes a relative move (rotation) to the drive lever 161 until the auxiliary drive member 163 abuts the right inclined wall part 161*s* (R) formed at the upper end of the right wall part 161*w* (R) of the drive lever 161. When the auxiliary drive lever 163 abuts the right inclined wall part 161*s* (R), the auxiliary drive lever 163 and the right inclined wall part 161*s* (R) rotate in one and with this rotation, the drive cam 160C is rotated in a predetermined direction (in the example, clockwise). When the drive cam 160C rotates, the abutment face with the guide roll 156R of the first moving support member 156 moves and is changed from the high load surface $C_1$ to the release surface $C_2$, resulting in a state as shown in FIG. 6(*b*). At this time, the first moving support member 156 rotates in a predetermined direction (in the example, clockwise in FIG. 2) by the reaction force of the nip load and the second moving support members 157 rotates in the opposite direction (in the example, counterclockwise in FIG. 2) by the compression spring S and the moving end part 157*e* abuts the fixed end part 152*e* and stops. At this time, the nip load is released, making it possible to easily bring the fixing belt 153 and the heating roll 151 away from each other.

When the abutment face makes a transition from the high load surface $C_1$ to the release surface $C_2$, the drive cam 160C rotates and moves to the release surface $C_2$ prior to the auxiliary drive lever 163 by the urging force of the compression spring S and is engaged in a recess part of the release surface $C_2$. That is, the drive lever 161 joined to the drive cam 160C is driven in one with the auxiliary drive lever 163 and then makes a relative move (rotation) to the auxiliary drive lever 163 in advance and then stops before the auxiliary drive lever 163 is disassociated from the cover claw part Ca. Then, the cover claw part Ca rotates and moves so as to follow the drive lever 161 which rotated and moved in advance with the opening operation of the cover 100C and again comes in contact with the auxiliary drive lever 163 and the auxiliary drive lever 163 makes a relative move to the drive lever 161 and is disassociated from the cover claw part Ca. The auxiliary drive lever 163 disassociated from the cover claw part Ca rotates in the opposite direction by the elastic force of the connection spring S1 and enters a wait state in which it returns upstream of the movement trajectory $L_0$ of the tip part of the cover claw part Ca when the auxiliary drive lever 163 is disassociated from the cover claw part Ca.

Therefore, when a transition is made from the high nip load state to the nip release state with the opening operation of the cover 100C, at the starting time and at the time of disassociating from, the cover 100C comes in contact only with the auxiliary drive lever 163 and thus the starting torque and the load torque at the time of disassociating from are lightened and smooth starting with the cover 100C and smooth disassociating from the cover 100C are made possible. Further, the drive lever 161 is driven in one halfway through the opening/closing operation of the cover 100C, so that the operability of the whole opening/closing operation sequence improves using the inertial force at the time of the rotation operation.

When the cover 100C is closed after any desired operation of jam handling, unit replacement, etc., in the wait state in which the cover 100 is opened, the auxiliary drive lever 163 returns to the movement trajectory $L_0$ of the cover claw part Ca and thus the nip load is automatically changed from the release state to the high press contact state with the closing operation of the cover 100C according to the reverse procedure to the opening operation described above.

To set the nip load to the envelope mode to fix an image on a cardboard of an envelope, etc., when opening the cover 100C, the operator may further rotate the handle part 161*a* of the drive lever 161 in a predetermined direction (in the example, clockwise), thereby easily switching to any desired nip load. Specifically, when the drive lever 161 is further rotated in the predetermined direction (in the example, clockwise) from a state in which the release surface $C_2$ of the drive cam 160C is in contact with the guide roll 156R, the drive cam 160C is rotated in one in the predetermined direction (in the example, clockwise) and the abutment face with the guide roll 156R of the first moving support member 156 is changed from the release surface $C_2$ to the low load surface $C_3$. At this time, the first moving support member 156 is pressed against the drive cam 160C through the guide roll 156R and rotates in a predetermined direction (in the example, counterclockwise in FIG. 2) and only the pad part 155*a* presses the fixing belt 153 for changing the abutment angle of the sub pressing member 155 and the fixing belt 153 so as to form the fixing nip area n. At this time, the moving end part 157*e* of the second moving support member 157 maintains the abutment state with the fixed end part 152*e* of the fixed support member 152 by the elastic force of the compression spring S and gives predetermined low nip load to the nip between the heating roll 151 and the fixing belt 153 for preventing occurrence of a sheet wrinkle of a cardboard of an envelope, etc.

Thus, the drive lever 161 of the switching unit 160 is switched, whereby the nip load and the nip abutment angle may be changed and the sub pressing member 155 to form the fixing nip area n may be changed and it is made possible to set appropriate nip load and sub pressing member responsive to a recording medium.

Second Exemplary Embodiment

Figure 7A:
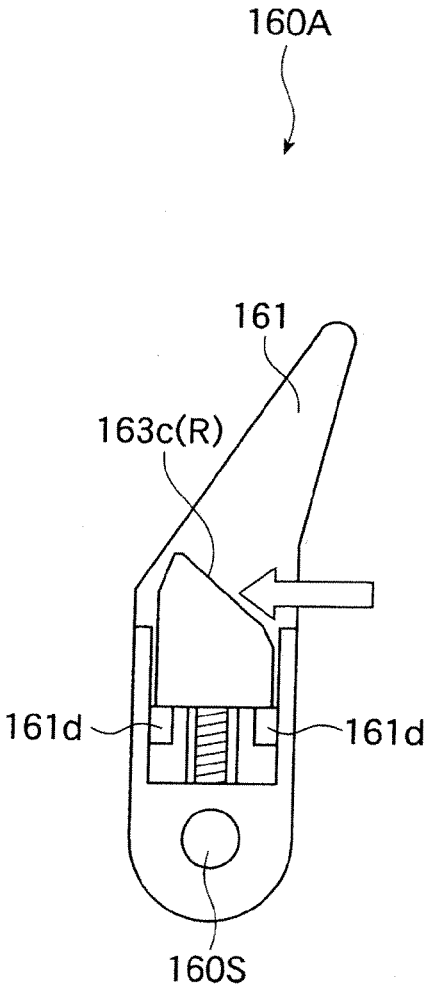
FIG. 7 is a schematic drawing to show another exemplary embodiment of the switching unit according to the invention.
Figure 7B:
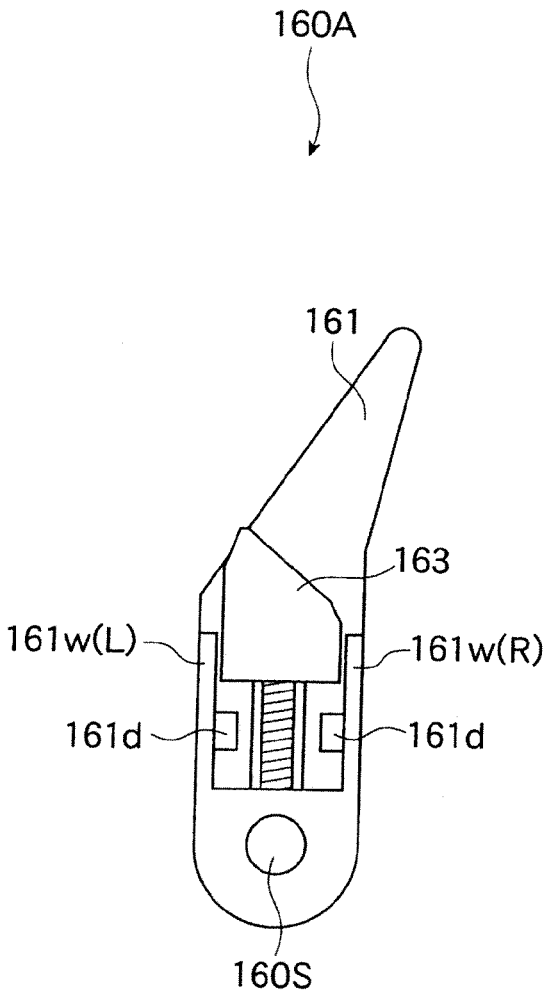

Next, a second exemplary embodiment of the switching unit according to the invention will be further discussed with reference to FIG. 7. FIG. 7(*a*) is a schematic drawing to show a state in which connection spring S2 is compressed and auxiliary drive lever 163 moves to the inside in the radial direction, and FIG. 7(*b*) is a schematic drawing to show a state in which the connection spring S2 is decompressed and the auxiliary drive lever 163 moves to the outside in the radial direction.

The switching unit 160 in the first exemplary embodiment rotates and moves the auxiliary drive lever 163 in the predetermined direction by contact with the cover 100C (cover claw part Ca); while, switching unit 160A according to the second exemplary embodiment linearly moves the auxiliary drive lever 163 in a predetermined direction by contact with the cover 100C (cover claw part Ca). Members having functions similar to those of the first exemplary embodiment are denoted by similar reference numerals and will not be discussed again in detail.

As schematically shown in FIG. 7, in the switching unit 160A according to the second exemplary embodiment, the auxiliary drive lever 163 is housed and is placed so as to make a linear move in the axial projection area of a drive lever 161. Specifically, the auxiliary drive lever 163 is placed in left and right wall parts 161*s* (R) and 161*w* (L) of the drive lever 161 and the auxiliary drive lever 163 and the drive lever 161 are connected by the connection spring S2 so that the auxiliary drive lever 163 may make a linear move relative to the drive lever 161.

In the switching unit 160A according to the second exemplary embodiment described above, as schematically shown in FIG. 7(*a*), for example, if the cover claw part Ca drives the tip of the auxiliary drive lever 163 in the arrow direction in the figure, the drive force is converted in a rotation shaft 160S direction because of the inclined shape of a contact surface 163*c* (R) of the auxiliary drive lever 163 and only the auxiliary drive lever 163 makes a linear move in the rotation shaft 160S direction against the connection spring S2 and when the auxiliary drive lever 163 abuts an abutment part 161*d*, the drive lever 161 is driven in one. When the abutment face of a drive cam 160C joined to the drive lever 161 makes a transition from a high load surface $C_1$ to a release surface $C_2$, the load of the drive lever 161 is lightened combined with the urging force of a compression spring S before the auxiliary drive lever 163 is disassociated from the cover claw part Ca as in the first exemplary embodiment. Thus, the auxiliary drive lever 163 once makes a relative linear move to the outside in the radial direction by the connection spring S2 and then when the drive lever 161 is held on the release surface $C_2$ of the drive cam 160C, again the auxiliary drive lever 163 makes a relative linear move to the inside in the radial direction. Accordingly, when the auxiliary drive lever 163 is driven and when the auxiliary drive lever 163 is disassociated from the cover claw part Ca, the cover claw part Ca drives only the auxiliary drive lever 163 as in the first exemplary embodiment, and a similar advantage to that of the first exemplary embodiment can be provided.

In the fixing device 15 according to the invention described above, the switching unit 160, 160A that switches the press contact force nip load) into the heating roll 151 is divided into the auxiliary drive lever 163 operatively associated with the cover 100C and the drive lever 161 joined to the drive cam 160C, so that the operation force may be decreased as compared with the configuration wherein the nip load is changed by an operation lever directly connected to a pressing member as in the related arts. In the wait state, the auxiliary drive lever 163 of the division part always returns to the movement trajectory $L_0$ of the cover 100C and thus drive operation with the same member is made possible, contributing to compacting and cost reduction. In addition, the allowable range of the relative position tolerance accompanying parts tolerance is enlarged and the press contact force switching operation reliably operatively associated with the opening/closing operation of the cover 100C is made possible by simple design.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A fixing device comprising:

a heating member that includes an internal heating source and is rotatable;

a pressing member that presses the heating member into contact therewith;

a switching unit that switches a press contact force of the pressing member, which is applied to the heating member; and a container body that accommodates the heating member, the pressing member and the switching unit, wherein the switching unit includes:

a drive member that is rotatable and moves the pressing member in a predetermined direction; and an auxiliary drive member that is connected to the drive member and relatively moves with the drive member in a predetermined range, and the auxiliary drive member, in a case where the container body is placed in an image forming apparatus including a lid that is openable and closable, switches between an operative association state where the auxiliary drive member is driven in a predetermined direction in association with opening/closing operation of the lid of the image forming apparatus and a nonoperative association state where the auxiliary driving member is dissociated from opening/closing operation of the lid, the auxiliary drive member including a returning section that returns a tip of the auxiliary drive member to a position crossing a movement trajectory of the lid in the nonoperative association state.

2. The fixing device as claimed in claim 1, wherein the auxiliary drive member is placed so that both end parts of a movement trajectory of the tip of the auxiliary drive member cross on the movement trajectory of the lid.

3. The fixing device as claimed in claim 1, wherein the lid drives relative to the drive member via the auxiliary drive member when the press contact force is switched, and drives only the auxiliary drive member at a starting time when the lid starts to drive and at a dissociated time when the auxiliary drive member is dissociated from the lid.

4. The fixing device as claimed in claim 1, wherein the auxiliary drive member has a contact surface substantially orthogonal to the movement trajectory of the lid when the auxiliary drive member returns, and the contact surface is formed as a shape duplicated the movement trajectory of the lid when the auxiliary drive member is dissociated from the lid.

5. The fixing device as claimed in claim 1, wherein the auxiliary drive member is placed in an axial projection area of the drive member in the nonoperative association state.

6. The fixing device as claimed in claim 1, wherein the pressing member includes an endless belt member and a sub pressing member that presses the heating member through the endless belt member to form a predetermined nip area between the endless belt member and the heating member, and the sub pressing member is changed by switching the switching unit.

7. An image forming apparatus comprising:

an image forming section that forms an image on a recording medium;

a fixing section that fixes the image formed on the recording medium;

a housing that accommodates the image forming section and the fixing section therein; and a lid that is provided to a part of the housing and is openable and closable, wherein the fixing section includes:

a heating member that includes an internal heating source and that is rotatable;

a pressing member that presses the heating member into contact therewith;

a switching unit that switches a press contact force of the pressing member, which is applied to the heating member; and a container body that accommodates the heating member, the pressing member, and the switching unit, wherein the switching unit includes:

a drive member that is rotatable and moves the pressing member in a predetermined direction; and an auxiliary drive member that is connected to the drive member and relatively moves the drive member in a predetermined range, and the auxiliary drive member, in the case where the container body is placed in the image forming apparatus, switches between an operative association state where the auxiliary drive member is driven in a predetermined direction relative to opening/closing operation of the lid of the image forming apparatus and a nonoperative association state where the auxiliary drive member is dissociated from opening/closing operation of the lid and the switching unit, the auxiliary drive member including a returning section that returns a tip of the auxiliary drive member to a position crossing a movement trajectory of the lid in the nonoperative association state.

* * * * *